US011337536B2

(12) United States Patent
Mitchell

(10) Patent No.: US 11,337,536 B2
(45) Date of Patent: May 24, 2022

(54) CLOTHING HANGER WITH BUILT-IN LIGHTS

(71) Applicant: Tonia Mitchell, Yonkers, NY (US)

(72) Inventor: Tonia Mitchell, Yonkers, NY (US)

(73) Assignee: JOB MOMMA, LLC, Yonkers, NY (US)

( * ) Notice: Subject to any disclaimer, the term of this patent is extended or adjusted under 35 U.S.C. 154(b) by 0 days.

(21) Appl. No.: 16/378,214

(22) Filed: Apr. 8, 2019

(65) Prior Publication Data

US 2020/0337488 A1 Oct. 29, 2020

Related U.S. Application Data

(60) Provisional application No. 62/654,668, filed on Apr. 9, 2018.

(51) Int. Cl.

| | |
|---|---|
| ***A47G 25/14*** | (2006.01) |
| ***F21V 23/04*** | (2006.01) |
| ***F21Y 115/10*** | (2016.01) |

(52) U.S. Cl.

CPC ..... *A47G 25/14* (2013.01); *F21V 23/045* (2013.01); *F21V 23/0471* (2013.01); *F21Y 2115/10* (2016.08)

(58) Field of Classification Search

CPC ..... A47G 25/14; A47G 25/1407; A47G 2200/08; A47G 2200/085; F21V 23/045; F21V 23/0471; F21Y 2115/10

USPC ..... 223/85

See application file for complete search history.

(56) References Cited

U.S. PATENT DOCUMENTS

2009/0129972 A1* 5/2009 Di Bono ..... A47G 25/60 422/5
2010/0327766 A1* 12/2010 Recker ..... H02J 7/00308 315/291
2015/0272364 A1* 10/2015 Larsen ..... G09F 9/35 223/96

FOREIGN PATENT DOCUMENTS

CN 201920432 U * 8/2011
DE 202011003282 U1 * 6/2011 ..... A47G 25/1407

* cited by examiner

*Primary Examiner* — F Griffin Hall
(74) *Attorney, Agent, or Firm* — Leason Ellis LLP

(57) ABSTRACT

A clothes hanger includes a shoulder sleeve frame supporting a garment, a hook connected to the shoulder sleeve to hang on an external point, a light emitting device mounted on a top center portion of the sleeve frame, and a motion sensor communicating with the light emitting device to enable the light emitting device when external motion occurs.

14 Claims, 10 Drawing Sheets

204

CLOTHING HANGER WITH BUILT-IN LIGHTS

CROSS-REFERENCE TO RELATED APPLICATION

This application claims priority under 35 U.S.C. § 119 to U.S. Provisional Patent Application No. 62/654,668, filed on Apr. 9, 2018, hereby incorporated herein by reference in its entirety.

BACKGROUND OF THE INVENTION

Field of the Invention

The disclosed invention relates generally to an embodiment of a method, apparatus and system for supporting a garment or other item, and more particularly, but not by way of limitation, relating to a method, apparatus, and system for a clothing hanger with built-in lights such as LED (light emitting diodes).

Description of the Background Art

With the increased population and busy schedules today, people have less time to arrange and manage their clothes. In smaller spaces there are dark areas that fixed lighting cannot quickly provide proper lighting to view the storage items.

In such small closets, rooms, or storage areas with poor lighting, there is a need for innovative ways for providing lighting. There is a need that such lighting can be easily and efficiently provided.

SUMMARY OF INVENTION

In view of the foregoing and other problems, disadvantages, and drawbacks of the aforementioned background art, an exemplary aspect of the disclosed invention provides a method, apparatus, and system for a built-in LED lights that can be automatically turned on or remotely turned on.

One aspect of the present invention is to provide a clothes hanger, including a shoulder sleeve frame supporting a garment, a hook connected to the shoulder sleeve to hang on an external point, a light emitting device mounted on a top center portion of the sleeve frame, and a motion sensor communicating with the light emitting device to enable the light emitting device when external motion occurs.

Another aspect of the present invention provides a hanger apparatus, including a frame supporting an object, a hook connected to the frame to hang on an external point, a light emitting device mounted on a top center portion of the frame, and a motion sensor communicating with the light emitting device to enable or disable the light emitting device.

Another example aspect of the disclosed invention is to provide a clothing hanger, including a left and a right shoulder seam, an LED (light emitting diode) device mounted on said left shoulder seam, an LED device mounted on said right shoulder seam, an LED device mounted at the bottom between the left and the right shoulder seams, and a motion sensor and a remote RF (radio frequency) receiver and controlling chip and cell battery are installed in the center portion around a hook.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

It is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF DRAWINGS

The exemplary aspects of the invention will be better understood from the following detailed description of the exemplary embodiments of the invention with reference to the drawings.

DETAILED DESCRIPTION OF PREFERRED EMBODIMENTS

Figure 1:
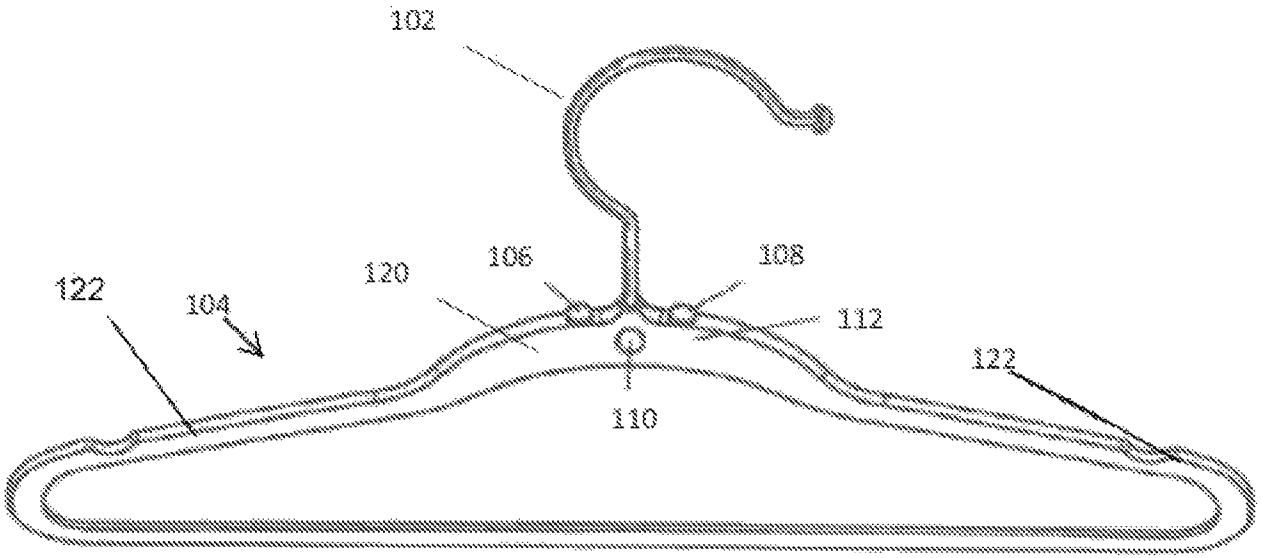
FIG. 1 illustrates a hanger of an example embodiment.

The invention will now be described with reference to the drawing figures, in which like reference numerals refer to like parts throughout. It is emphasized that, according to common practice, the various features of the drawing are not necessarily to scale. On the contrary, the dimensions of the various features can be arbitrarily expanded or reduced for clarity. Exemplary embodiments are provided below for illustration purposes and do not limit the claims.

FIG. 1 illustrates a clothes hanger of an example embodiment. The hanger 100 for clothing (clothes hanger) includes a hanging portion 102 connected to the body portion 104 that supports the clothes. In the top portion 112 of the body 104, resides the electronic system 120. A light portion 110 is included in the electronic system, and there can be input devices, sensors or additional lights 106 and 108. The light portion 110 can be a light emitting diode (LED) 110 or other types of light element. References 106 and 108 can also be additional LEDs or other type of optional control input button.

The hanger 100 can be non-slip velvet hanger, or other clothing hangers can be configured with LED lights 110. The hanger 100 can be used in closets or storage with poor lighting. One or a few of these clothing hangers 100 would be sufficient to provide needed lighting to see all the clothes in a small or large space, and no need for additional installation of lights. The number of hangers 100 can vary, allowing the flexibility to light the area of the room. The hangers 100 can be positioned in the corners of a closet or at any interval. The Light 110 pours into hard to reach places that overhead lighting simply cannot get to and can be done in a flexible manner. Lights 106 and 108 can provide additional source of lighting to further light the room from different directions. A user can simply hang up the clothes as usual, with no need for installation of additional lighting, with a touch of a button (optional 106 and 108) for remote control or waving the hand, the LED lights 110 (optionally 106 and 108) are turned on and the closet is lit. The lights will also be automatically turn off after a few minutes or seconds. The time can be preprogrammed or changed with a remote device.

Figure 2:
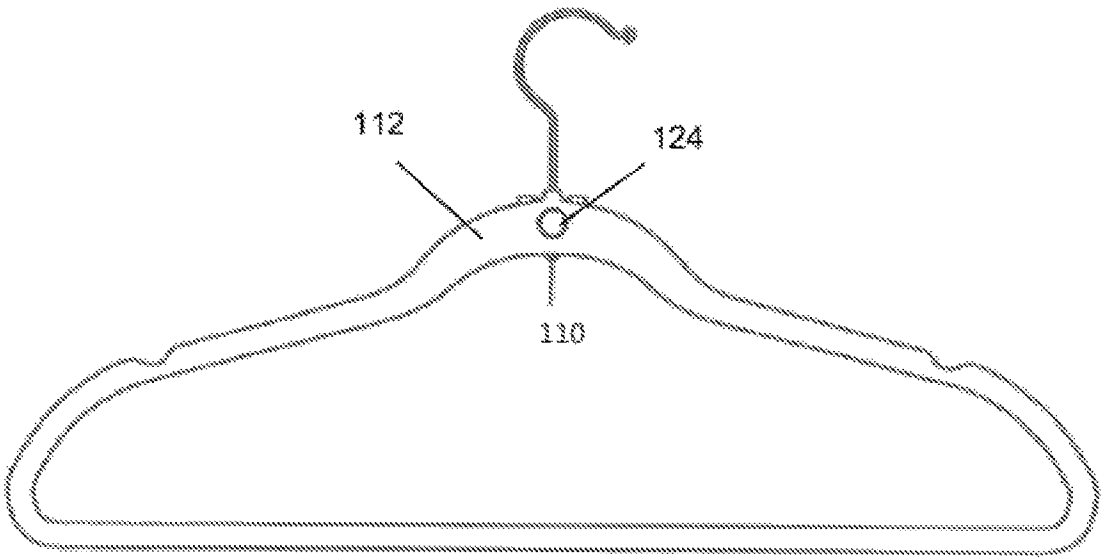
FIG. 2 is an illustration of another view of the hanger of the example embodiment.
Figure 3:
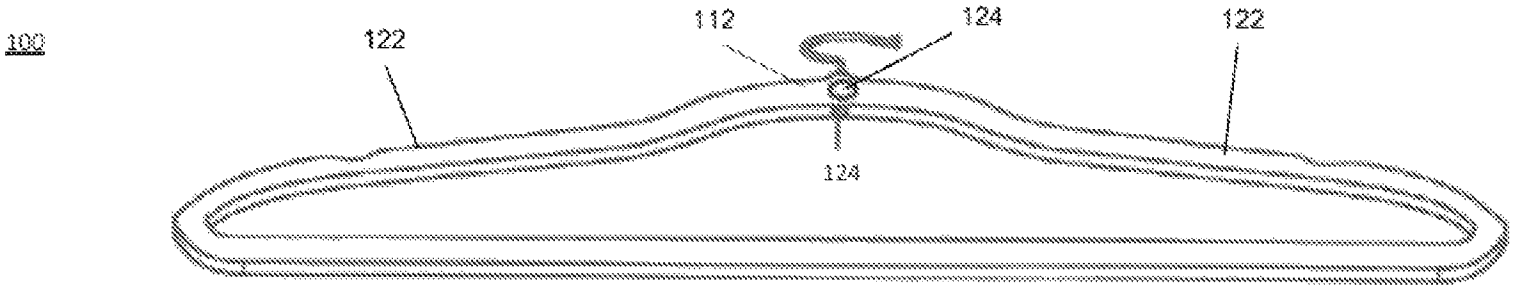
FIG. 3 is an illustration of the upper portion of the hanger of the example embodiment.

FIG. 2 is an illustration of another sectional view of the hanger of the example embodiment. FIG. 3 is an illustration of yet another view of the hanger of the example embodiment.

Referring to FIGS. 1-3, 106, 108 and 110 LED lights are configured on hanger top portion 112. Battery and electronic chips for controlling the LED lights 110 are installed in a compartment 124 inside hanger body 104, preferably located at the center portion between the left and right should hanger seams 122.

As shown above, a clothing hanger 100 is provided to have a set of built-in LED lights 106, 108, 110 that can be configured on the edges around the hanging portion 102 on the shoulder seams 122. A compartment 124 is configured on the center portion between the shoulder seams 122.

The compartment 124 is configured to the center portion between the shoulder seams 122, and motion sensors and/or remote-control chips powered by a primary cell or secondary battery may be installed inside the compartment 124. FIG. 3 shows a compartment 124 at the bottom side of the top portion 112. FIG. 2 provides a sectional view of compartment 124. These LED lights 106, 108, 110 are therefore configured to be motion sensitive and/or be controlled by a remote control.

Figure 4:
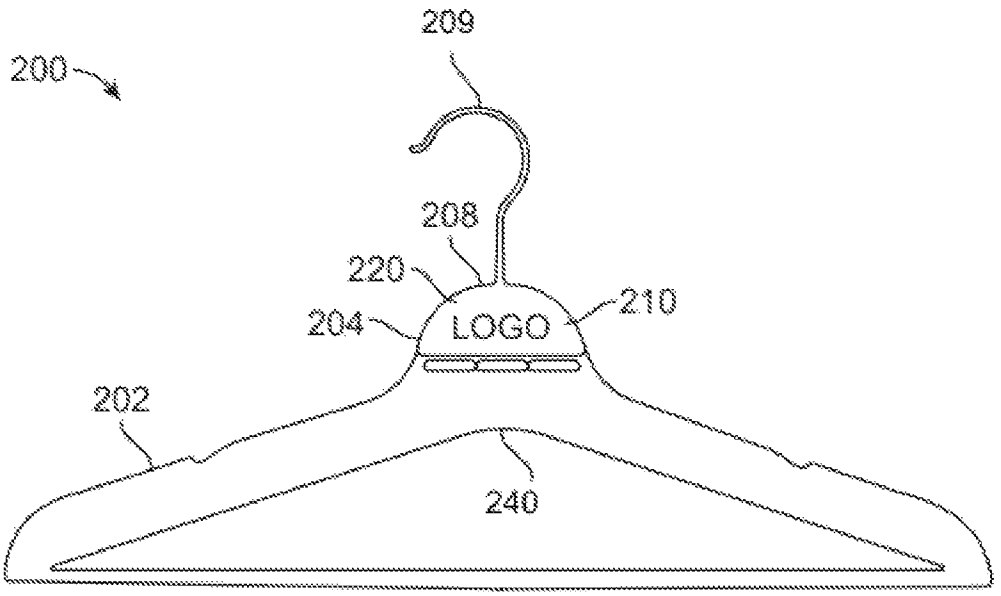
FIG. 4 illustrates a hanger of another example embodiment.

FIG. 4 illustrates a hanger 200 of another example embodiment. The hanger 200 includes a hook portion 209 and a shoulder seam or frame 202 for hanging the clothes.

The hanger 200 can again be non-slip velvet hanger or other type of non-slip surface or any other type of surface or material. The clothing hanger 200 can be configured with LED lights 220 inside the area covered by 208 that are visible through a translucent or transparent material cover 208 to cover the electronic system 204. The cover 208 can include a permanent or changing logo 210 that is displayed via LEDs or permanent ink printed on the cover 208. The logo 210 can be changed manually or via an alphanumeric programmable LED visible through the compartment cover 208. The hanger 200 can be used in closets or storage. The cover 208 can optically help diffuse the light or direct the light.

It is helpful to locate the electronic system 204 with the LEDs 220 at the top center portion of hanger 200 to allow the clothes to be supported and provide the area where the light can be emitted from the LEDs 220 and motion to be detected by a motion detector without obstruction. The electronic system 204 can be located in other areas of the hanger 200 where there is no obstruction.

The number of hangers 200 can vary, allowing again the flexibility. The hangers 200 can be positioned in the corners of a storage or at any interval or location and can be manipulated or moved at any time in order to provide light in hard to reach spaces. The Light from the LED 220 pours into hard to reach places that overhead lighting simply cannot get to and can be done in a flexible manner. A user can simply hang up the clothes as usual, with no need for installation of additional lighting, with a touch of a button for remote control or waving the hand, the LED lights 220 are turned on and the closet is lit. The lights 220 will also be automatically turn off after a few minutes or seconds. The time can be preprogrammed or changed with the remote device. The translucent cover 208 also helps provide outside feedback to any internal sensor (such as an infrared motion sensor) used in the remote control or motion sensing of a wave of the hand.

The passive infrared (PIR) motion sensor or other type of infrared sensor, a part of electronic system 204, is helpful in the dark since it senses infrared energy and enables the light emitting device 220 to turn on when a user enters a dark room.

Figure 5:
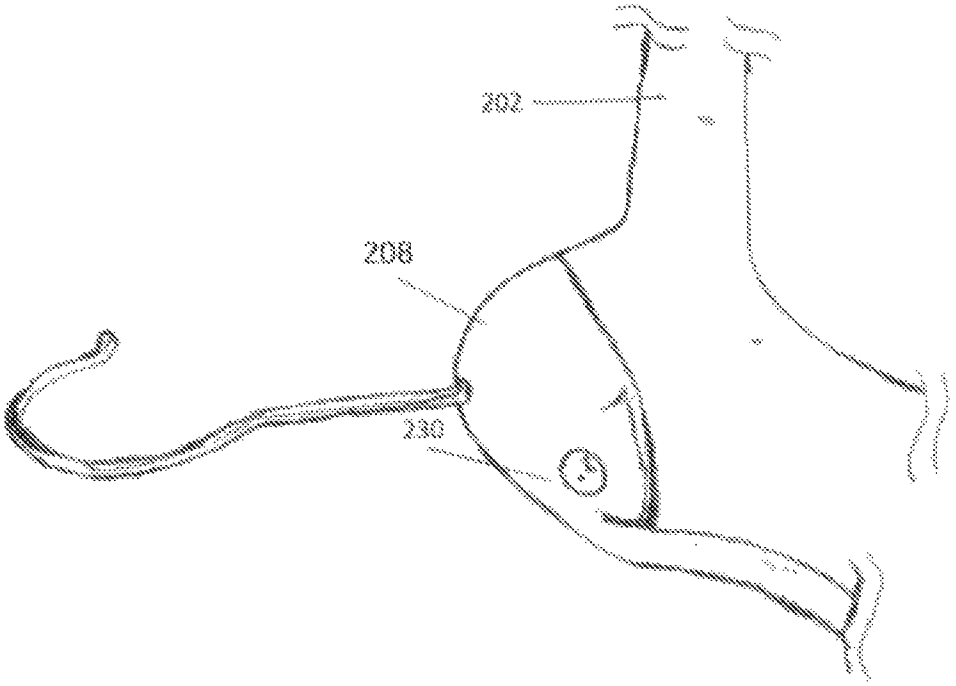
FIG. 5 is an illustration of another view of the other example embodiment.

FIG. 5 is an illustration of another view of the other example embodiment. An input device or a sensor 230 can be located on a side portion of the compartment cover 208 that is located above the shoulder seam 202.

Figure 6:
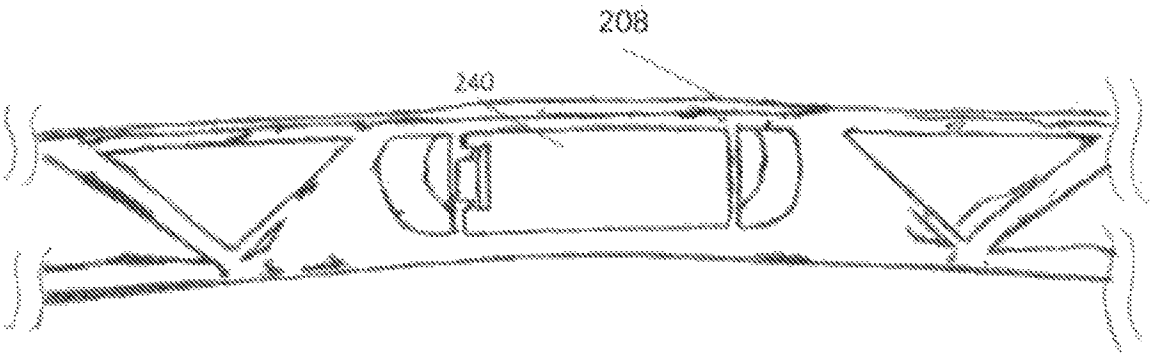
FIG. 6 is an illustration of a bottom view of the battery compartment of the other example embodiment.

FIG. 6 is an illustration of a bottom view of the battery compartment 240 of the other example embodiment of FIG. 4. At a bottom portion of the center section of the hanger 200 between the shoulder seams 202, there can be an easily accessible battery compartment 240 where the battery compartment cover can be easily removed. The battery compartment can be coin cell batteries or standard primary cell batteries such as AA or AAA type batteries, or secondary type rechargeable batteries.

Figure 7:
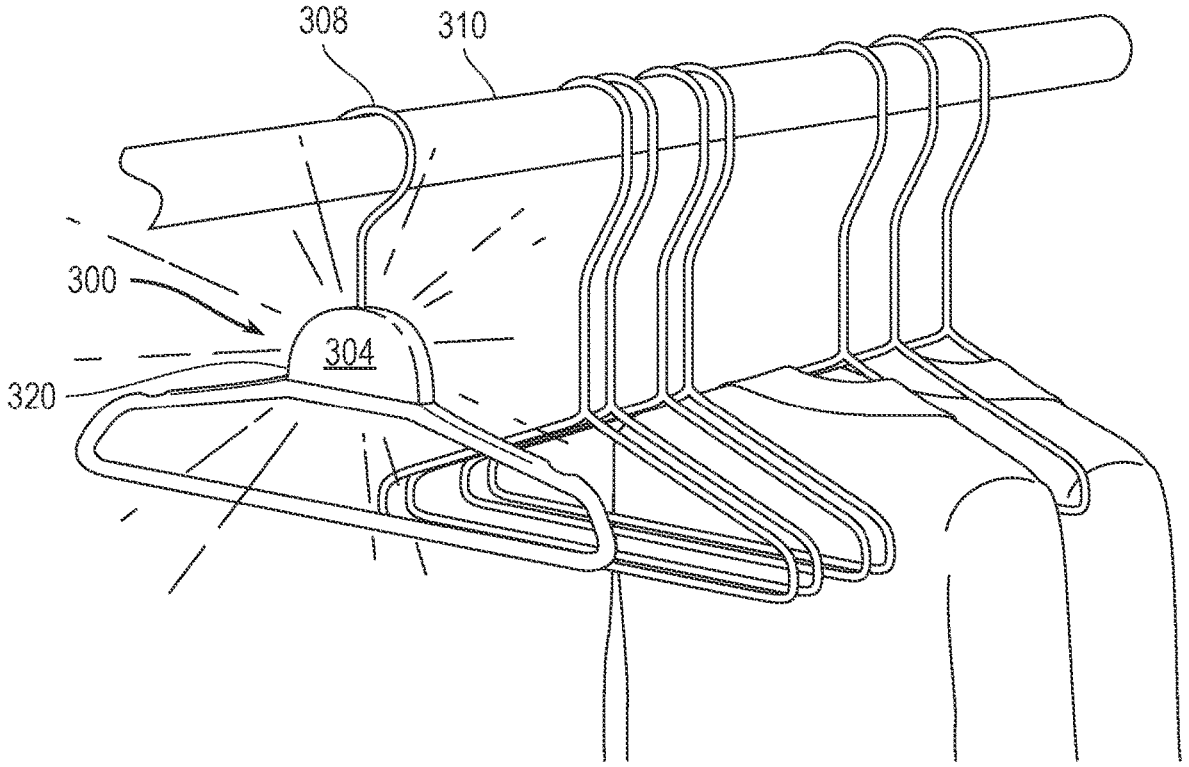
FIG. 7 shows a prototype image of the hanger of the example embodiment in a closet.

FIG. 7 shows a prototype hanger of the example embodiment in a closet. The hanger 300 has a hook 308 positioned on a bar 310 in the closet, where the light 320 lights up the entire top portion translucent cover 304 of the hanger 300 which lights up the closet in key positions, where a user can easily access other hangers and clothing that do not have the lights. The shelve units above the bar 310 can stop the overhead light from reaching such spaces, but the lights 320 inside 304 in the hanger 300 diffuses the light into such hard to reach spaces.

Figure 8:
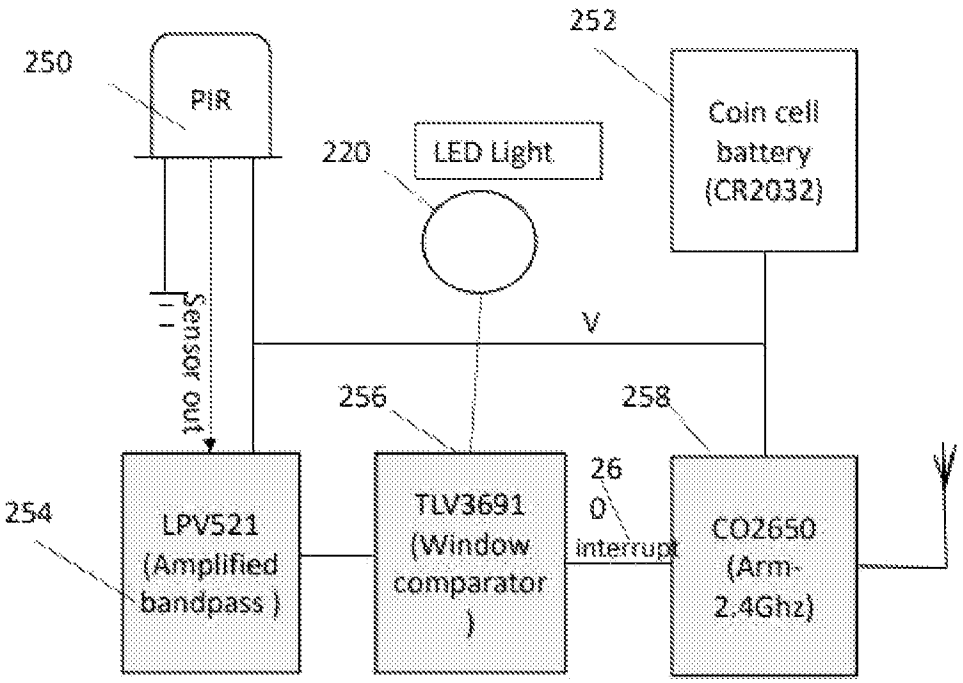
FIG. 8 illustrates an exemplary hardware system for incorporating the example embodiment of the invention therein.

FIG. 8 illustrates an exemplary hardware system for incorporating the example embodiment of the invention therein. The electronic system 204 can include an LED light 220 or any other type of light emitting device that is controlled. The light 220 can be powered by, for example, a battery 252. A sensor 250 that activates the light 220 can be a passive infrared sensor (PIR sensor) or other type of sensor that can sense motion of a user that can detect energy in the dark. The sensor 250 then sends a signal to the filter (e.g., amplified band pass filter) 254, which then sends to a comparator 256 (e.g., window comparator). The electronic system 204 can also be controlled via a wireless receiver 258, which sends an interrupt 260.

Figure 9:
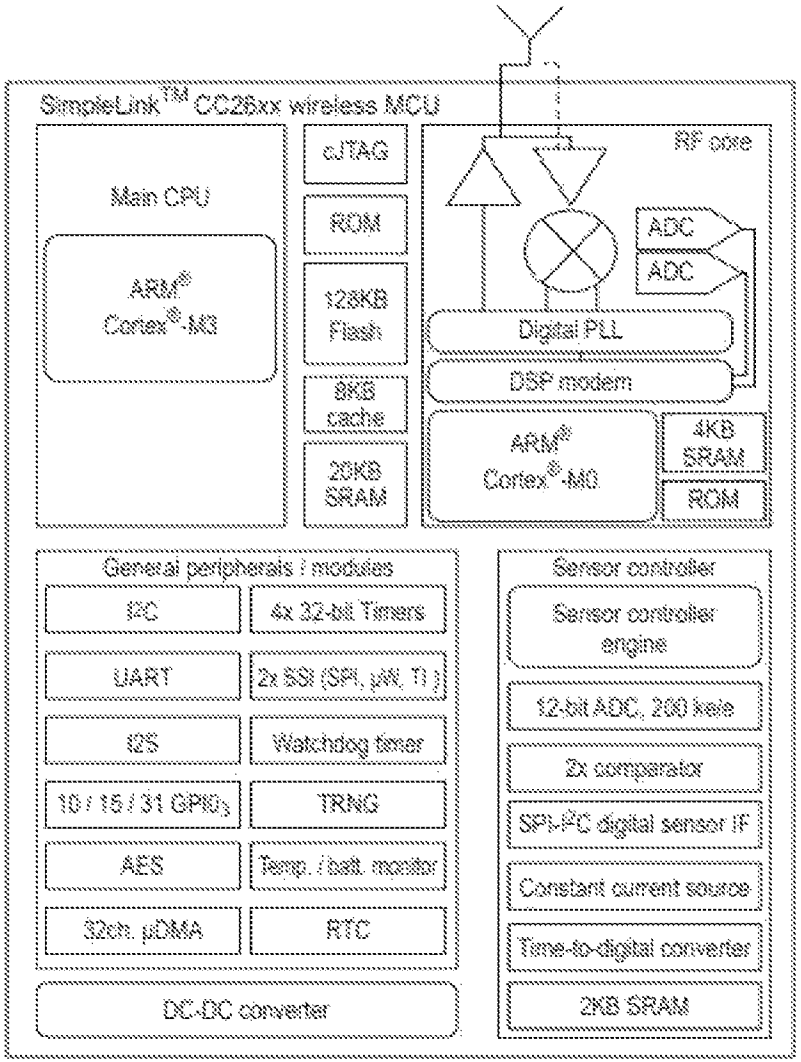
FIG. 9 illustrates an exemplary hardware system for incorporating the example embodiment of the invention therein.

FIG. 9 illustrates an exemplary hardware system for incorporating the example embodiment of the invention therein. An example of an ultra-low powered wireless microcontroller MCU is shown for the wireless receiver 258.

Figure 10:
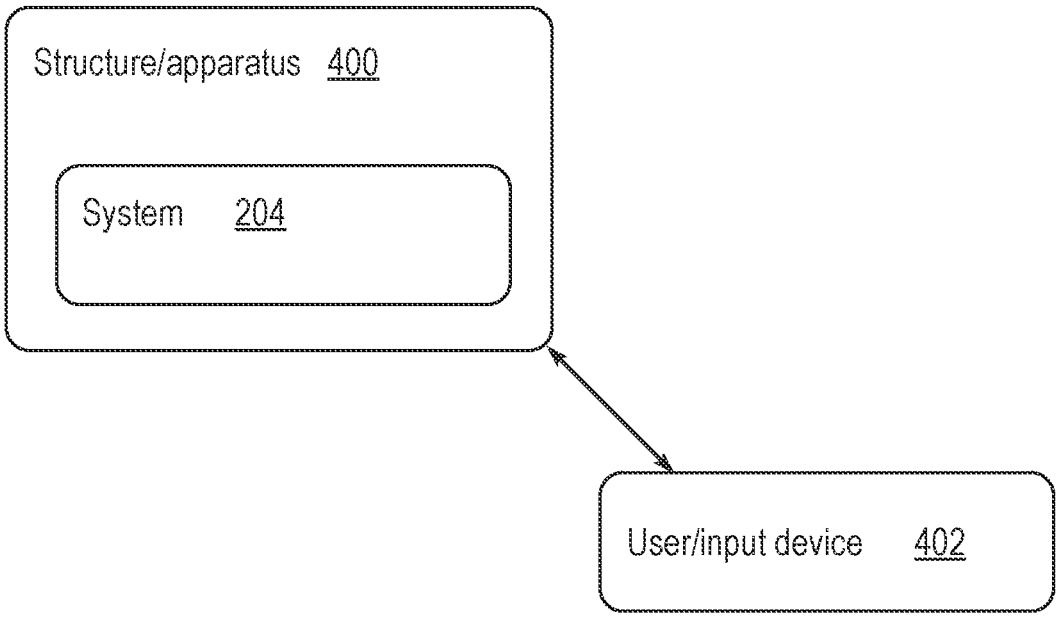
FIG. 10 illustrates another exemplary hardware system for incorporating the example embodiment of the invention therein.

FIG. 10 illustrates another exemplary hardware system for incorporating the example embodiment of the invention therein. The electronic system 204 can also be included in any type of structure or apparatus 400 that is activated via motion and/or wireless remote via a user or input device 402. The motion and wireless remote can communicate with the structure/apparatus 400 in dark environments. The electronic system 204 can be programmed or predetermined as to the motion sensitivity and automatic turning off time of the light in the system 204.

As shown above, referring back to FIG. 4, the hanger 200 not only accommodates clothes, but also flexibly lights up storage and closets. It is a two in one option with a hanger and a light together. With a no-slip velvet body, the hanger 200 is designed to make sure your items stay securely in place while lighting up the closet. Hanger 200 is motion activated as it turns on automatically even in dark environments. The hanger 200 can sense motion ten or more feet away. The sensitivity of the sensor 250 (See FIG. 8) can be increased or reduced if needed depending on the storage space or closet dimensions and the ambient lighting conditions. The hanger 200 can be used under shelves and dark corner pockets where most closet lights cannot reach. The hanger 200 can be used, for example, coat closets, dorm room closets, wardrobe closets, boat closets and more.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

It is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

What is claimed is:

1. A clothes hanger, comprising:

a left shoulder sleeve frame and a right shoulder sleeve frame for supporting a garment;

a center portion located between the left shoulder sleeve frame and the right shoulder sleeve frame, said center portion having:

a top portion consisting of:

a translucent cover; and an electronic system disposed within the translucent cover and having a light bulb, wherein when the light bulb lights up, the translucent cover emits light from the light bulb; and a bottom portion having a compartment with an openable structure for accessing the compartment;

a hook connected to the center portion for anchoring the clothes hanger to an external point; and a motion sensor mounted on said clothes hanger communicating with the electronic system to cause the light bulb to light up when external motion occurs.

2. The clothes hanger according to claim 1, further comprising a remote RF (radio frequency) receiver communicating with the electronic system to turn on or off the light bulb.

3. The clothes hanger according to claim 1, wherein the electronic system is configured to control the light bulb and the motion sensor to turn on or off the light bulb based on external movement in dark environments.

4. The clothes hanger according to claim 1, further comprising an AA or AAA type of a battery that is installed inside the compartment wherein the battery is electronically coupled with the light bulb and the motion sensor.

5. The clothes hanger according to claim 1, wherein the light bulb includes a light emitting diode (LED).

6. The clothes hanger according to claim 1, wherein the light bulb includes a solid-state light emitting device.

7. The clothes hanger according to claim 1, wherein the motion detector includes a passive infrared (PIR) sensor to detect external motion of an object in a dark environment.

8. A hanger apparatus, comprising:

a left shoulder sleeve frame and a right shoulder sleeve frame for supporting an object;

a center section located between the left shoulder sleeve frame and the right shoulder sleeve frame, said center section having:

a top portion consisting of:

a translucent cover with a logo disposed thereupon; and an electronic system disposed within the translucent cover and having a light bulb, wherein when the light bulb lights up, the translucent cover emits light and the logo is visible from a distance; and a bottom portion configured with a compartment space with an openable structure for accessing the compartment;

a hook connected to the center section for hanging the hanger apparatus to an external point; and a motion sensor communicating with the electronic system to cause the light bulb to light up when external motion occurs.

9. The hanger apparatus according to claim 8, further comprising a remote RF (radio frequency) receiver communicating with the electronic system to turn on or off the light bulb.

10. The hanger apparatus according to claim 8, wherein the electronic system is configured to control the light bulb and the motion sensor to turn on or off the light bulb.

11. The hanger apparatus according to claim 8, further comprising an AA or AAA type of a battery that is installed inside the compartment, wherein the battery is electronically coupled with the light bulb and the motion sensor, and wherein the battery is configured to power the light bulb and the motion sensor.

12. The hanger apparatus according to claim 8, wherein the light bulb includes a light emitting diode (LED).

13. The hanger apparatus according to claim 8, wherein the light bulb includes a solid-state light emitting device.

14. The hanger apparatus according to claim 8, wherein the motion detector includes a passive infrared (PIR) sensor to detect external motion of an object.

* * * * *